US007555981B2

(12) United States Patent
Saito

(10) Patent No.: US 7,555,981 B2
(45) Date of Patent: Jul. 7, 2009

(54) ROLLER SUPPORT APPARATUS FOR PRINTING ROLLER

(75) Inventor: Nobuaki Saito, Ibaraki (JP)

(73) Assignee: Komori Corporation, Tokyo (JP)

( * ) Notice: Subject to any disclaimer, the term of this patent is extended or adjusted under 35 U.S.C. 154(b) by 672 days.

(21) Appl. No.: 10/874,709

(22) Filed: Jun. 23, 2004

(65) Prior Publication Data

US 2005/0035525 A1 Feb. 17, 2005

(30) Foreign Application Priority Data

Jun. 30, 2003 (JP) ..... 2003-187135

(51) Int. Cl.
*B41F 31/00* (2006.01)

(52) U.S. Cl. ..... 101/352.01; 101/352.03; 101/352.04; 101/352.08; 101/352.09

(58) Field of Classification Search ..... None
See application file for complete search history.

(56) References Cited

U.S. PATENT DOCUMENTS

| | | | | |
|---|---|---|---|---|
| 2,892,399 | A * | 6/1959 | Chase | 101/352.08 |
| 3,656,677 | A * | 4/1972 | Stepanek et al. | 226/180 |
| 3,715,979 | A * | 2/1973 | Erb et al. | 101/144 |
| 4,848,228 | A * | 7/1989 | Svoboda et al. | 101/147 |
| 5,113,762 | A * | 5/1992 | Abendroth et al. | 101/352.09 |
| 5,339,736 | A * | 8/1994 | Dorsam et al. | 101/352.02 |
| 6,347,585 | B1 * | 2/2002 | Kiamco et al. | 101/351.1 |

FOREIGN PATENT DOCUMENTS

| | | |
|---|---|---|
| DE | 1235956 | 3/1967 |
| EP | 0531658 | 3/1993 |
| GB | 122596 | 1/1919 |
| JP | 63-251237 | 10/1988 |
| JP | 09-039211 A | 2/1997 |

* cited by examiner

*Primary Examiner*—Jill E. Culler
(74) *Attorney, Agent, or Firm*—Blakely, Sokoloff, Taylor & Zafman LLP

(57) ABSTRACT

A roller support apparatus includes a compression coil spring, lever, bias canceling member, roller holder, and support. The compression coil spring biases the distribution roller in a direction to come close to the oscillating roller. The lever transmits a biasing force of the compression coil spring to the distribution roller. The bias canceling member cancels bias of the compression coil spring. The roller holder rotatable supports the distribution roller and pivots in accordance with movement of the lever. The support is provided to the roller holder and engages with a shaft portion of the distribution roller. The support brings the outer surface of the distribution roller into contact with the outer surface of the oscillating roller in accordance with pivot motion of the roller holder.

18 Claims, 4 Drawing Sheets

ROLLER SUPPORT APPARATUS FOR PRINTING ROLLER

BACKGROUND OF THE INVENTION

The present invention relates to a roller support apparatus and, more particularly, to a roller support apparatus provided to an inking device or dampening unit of a printing press to maintain the a contact pressure between two contacting rollers at a constant value.

In an inking device for an offset printing press, to uniform the thickness of ink to be supplied, a rubber roller and metal roller (an iron roller or a roller having a surface made of a hard metal such as copper) are rotated while their outer surfaces are in contact with each other, thus distributing the ink. According to this arrangement, the diameter of the rubber roller in contact with the metal roller changes due to wear or the like, leading to a change in contact pressure, i.e., nip pressure, between the rollers. When the nip pressure changes, the ink film thickness changes to largely adversely affect the printing quality. Therefore, conventionally, the inking device is provided with an adjustment unit which adjusts the nip pressure.

As shown in Japanese Patent Laid-Open No. 9-39211, a conventional roller support apparatus includes a support member which supports a distribution roller to be movable in directions to come close to and separate from an oscillating roller which is in contact with the distribution roller, a biasing member which biases the support member in a direction to urge the distribution roller against the oscillating roller, and a moving means for moving the distribution roller in the direction to separate from the oscillating roller against the biasing force of the biasing member.

In the conventional roller support apparatus described above, the biasing force of the biasing member is directly utilized without using a mechanism (amplification mechanism) that increases the biasing force. Hence, the biasing force itself of the biasing member must be large. In addition, in order to move the distribution roller in the direction to separate from the oscillating roller, the moving means is moved in the direction to accumulate the biasing force of the biasing member. The operation is thus cumbersome and time-consuming.

SUMMARY OF THE INVENTION

It is an object of the present invention to improve the workability for attaching and detaching the roller.

In order to achieve the above object, according to the present invention, there is provided a roller support apparatus with which an outer surface of a first roller and an outer surface of a second roller come into contact with and separate from each other by radially moving the first roller, comprising a biasing member which biases the first roller in a direction to come close to the second roller, a lever which transmits a biasing force of the biasing member to the first roller, bias canceling means for canceling bias of the biasing member, a roller holder which rotatably supports the first roller and pivots in accordance with movement of the lever, and an axial support which is provided to the roller holder and which engages with a shaft portion of the first roller, the axial support serving to bring the outer surface of the first roller into contact with the outer surface of the second roller in accordance with pivot motion of the roller holder.

BRIEF DESCRIPTION OF THE DRAWINGS

FIGS. 4A and 4B are views for explaining the relation between the distribution roller and the bearing portion of a roller holder in the inking device shown in FIG. 1, in which FIG. 4A shows a state wherein the distribution is separate from the oscillating roller, and FIG. 4B shows a state wherein the distribution roller is in contact with the oscillating roller; and FIGS. 5A and 5B are front views of a roller holder according to the second embodiment of the present invention, in which FIG. 5A shows the relationship between the bearing portion of the roller holder and the bearing of a distribution roller when the distribution roller is separate from an oscillating roller, and FIG. 5B shows the relationship between the bearing portion of the roller holder and the bearing of the distribution roller when the distribution roller is in contact with the oscillating roller.

DESCRIPTION OF THE PREFERRED EMBODIMENTS

The present invention will be described in detail with reference to the accompanying drawings.

Figure 1:
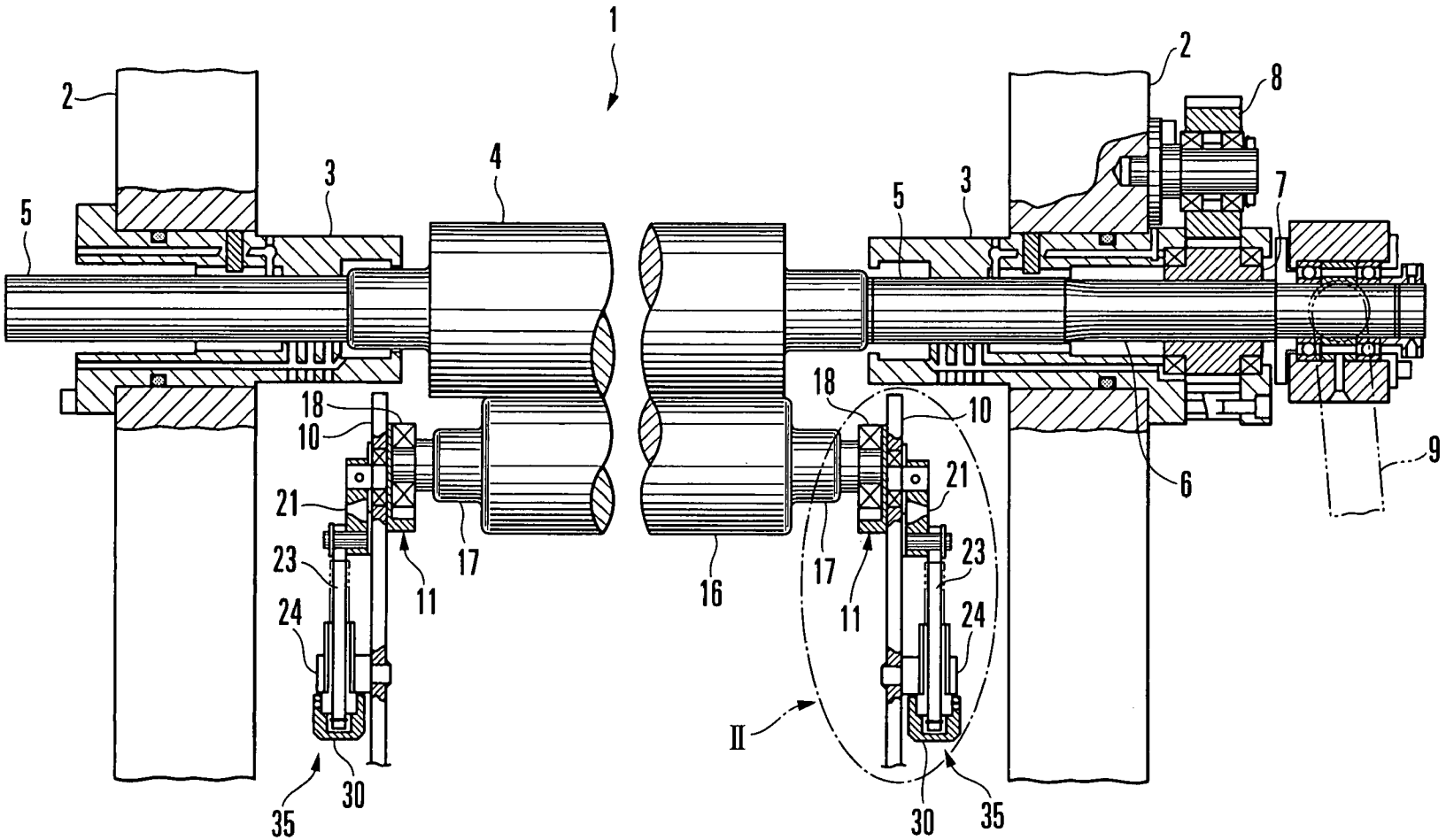
FIG. 1 is a partially cutaway developed front view of an inking device for a printing press according to the first embodiment of the present invention.

FIGS. 1 to 4B show an inking device for a printing press according to the first embodiment of the present invention. Referring to FIG. 1, an inking device 1 for the printing press includes a pair of opposing frames 2. An oscillating roller 4 as the second roller is axially supported by the pair of frames 2 through bearings 3 to be rotatable and movable in the axial direction. A gear 6 having a large face width is formed on one end shaft 5 of the oscillating roller 4, and the inner teeth of an intermediate gear 7 mesh with the gear 6. A driving gear 8 which transmits driving of a printing press motor meshes with the outer teeth of the intermediate gear 7, and one end portion of a driving oscillating lever 9 engages with the distal end portion of one end shaft 5. Therefore, when the printing press motor drives, the oscillating roller 4 rotates and moves reciprocally in the axial direction through the driving oscillating lever 9.

Figure 3A:
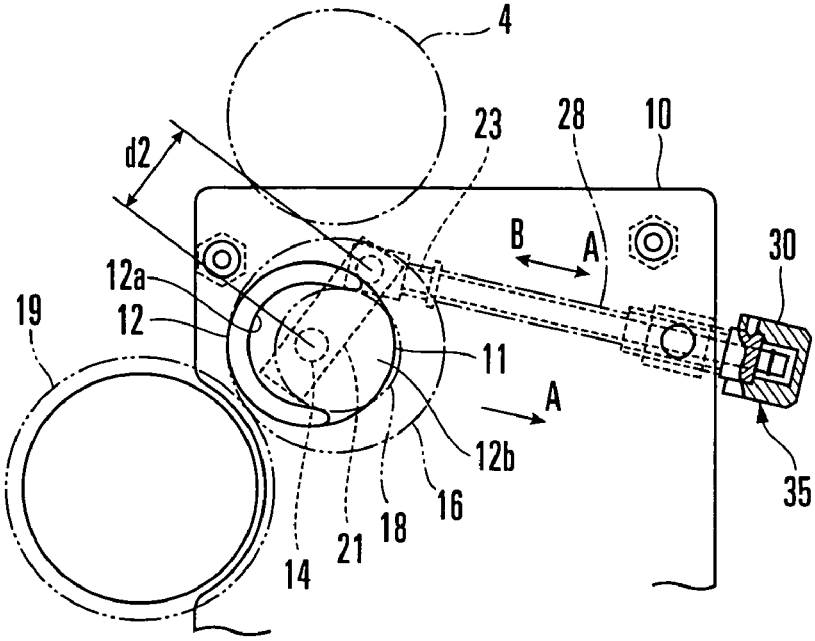
FIG. 3A is a view showing a state wherein a distribution roller is separated from an oscillating roller in the inking device shown in FIG. 1.
Figure 3B:
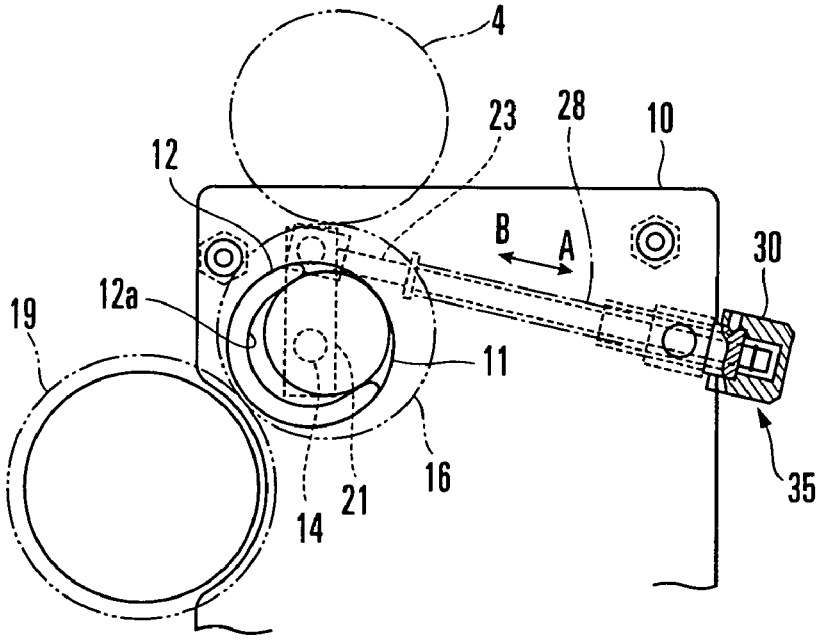
FIG. 3B is a view showing a state wherein the distribution roller is in contact with the oscillating roller in the inking device shown in FIG. 1.

A pair of inner frames 10 are arranged inside the pair of frames 2, and are attached to the frames 2 to be parallel to them through studs (not shown). As shown in FIGS. 3A and 3B, a bearing 12 integrally projects from one end face of each of a pair of substantially disk-like roller holders 11. The bearing 12 has a U-shaped bearing portion 12*a* for supporting a bearing 18 (to be described later) of a distribution roller 16 (to be described later). An opening 12*b* of the bearing portion 12*a* has an open length slightly larger than the diameter of the bearing 18.

Figure 2:
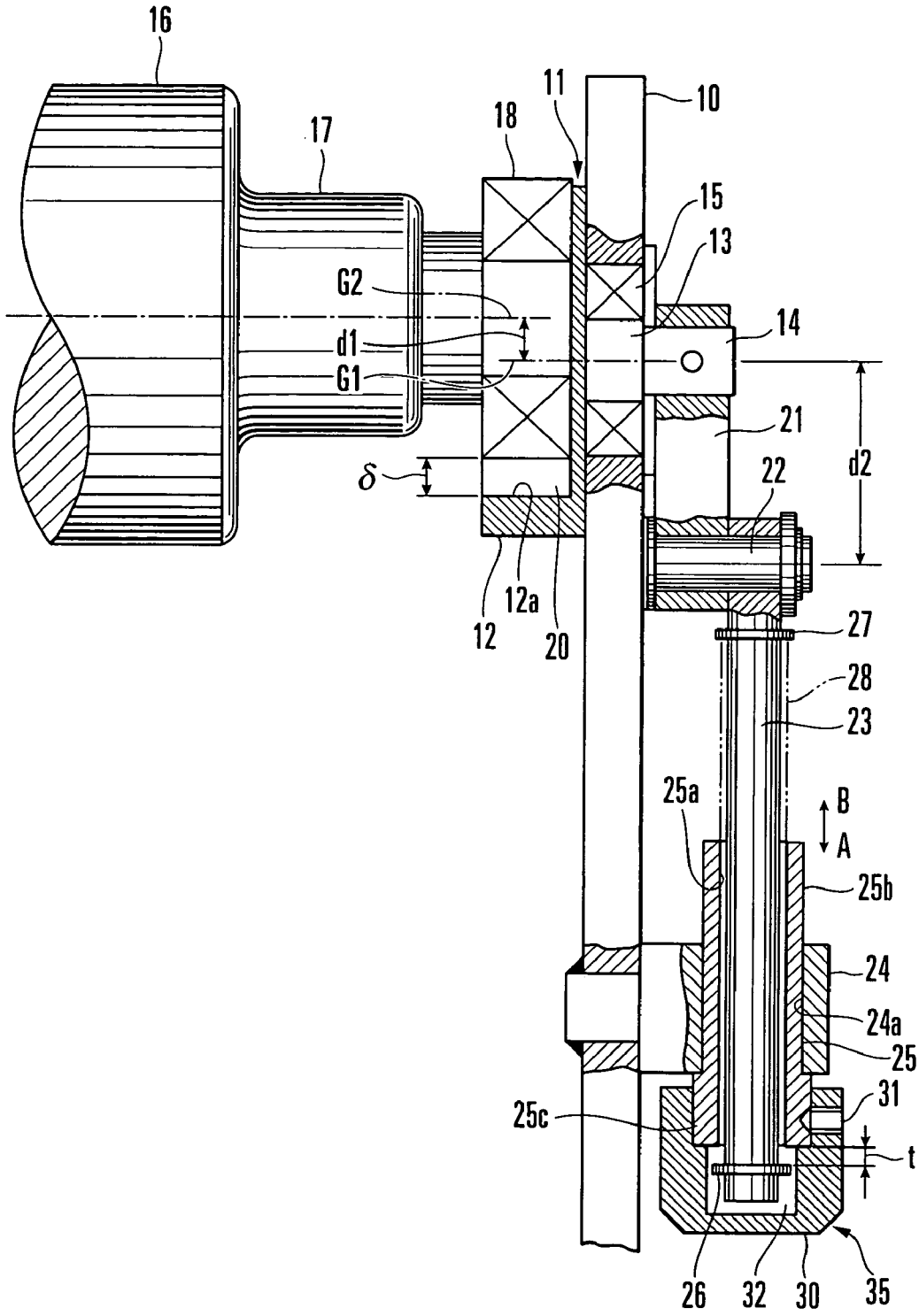
FIG. 2 is an enlarged view of portion II of FIG. 1.

As shown in FIG. 2, a first small shaft 13 integrally projects from the central portion of the other end face of each roller holder 11. A second small shaft 14 having a diameter smaller than that of the first small shaft 13 integrally projects from the first small shaft 13 to form a step. A bearing 15 is mounted on the first small shaft 13, and the roller holder 11 is rotatably supported by the corresponding inner frame 10 through the bearing 15. At this time, the bearing 12 is located inside the inner frame 10, and the second small shaft 14 projects outside the inner frame 10.

The bearing 18 is mounted on the distal end portion of each end shaft 17 of the distribution roller 16 serving as the first roller which is in contact with the oscillating roller 4. The distribution roller 16 is rotatably, axially supported by the bearing portions 12*a* of the pair of roller holders 11 through the bearings 18. An ink roller 19 (FIGS. 3A and 3B) serving as the third roller in contact with the distribution roller 16 is rotatably, axially supported by the frames 2.

The positional relationship between a shaft center G1 of the roller holder 11 and a shaft center G2 of the distribution roller 16 supported by the bearing 12 of the roller holder 11, and the positional relationship between the bearing 12 of the roller holder 11 and the corresponding bearing 18 of the distribution roller 16, when the distribution roller 16 is in contact with the oscillating roller 4, will be described.

Figure 4A:
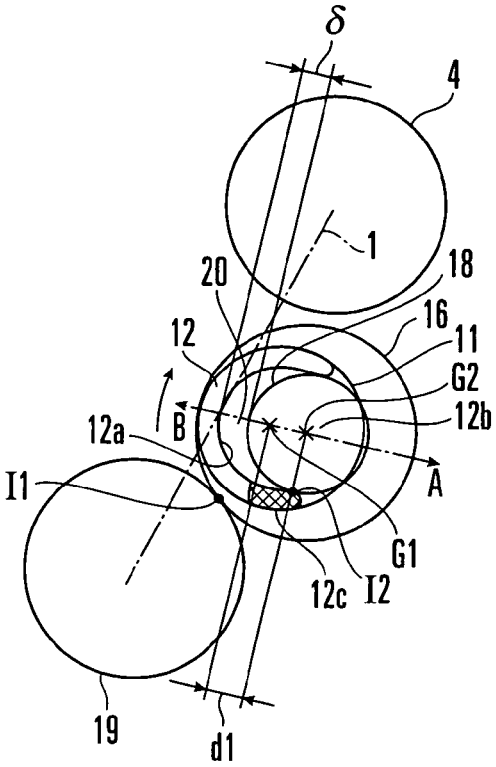

In the state shown in FIG. 4A wherein the distribution roller 16 is to be replaced, the opening 12*b* of the bearing 12 of the roller holder 11 is directed in the direction of an arrow A substantially perpendicular to a line 1 that connects the shaft centers of the oscillating roller 4 and ink roller 19. In this state, when the bearing 18 of the distribution roller 16 is engaged in the bearing portion 12*a* of the bearing 12 of the roller holder 11 to bring the distribution roller 16 into contact with the ink roller 19, the shaft center G2 of the distribution roller 16 is positioned to deviate from the shaft center G1 of the roller holder 11 by a distance d1. Simultaneously, a gap 20 with a distance δ is formed in the direction of an arrow B between the bearing 18 of the distribution roller 16 and the bearing portion 12*a* of the roller holder 11.

Figure 4B:
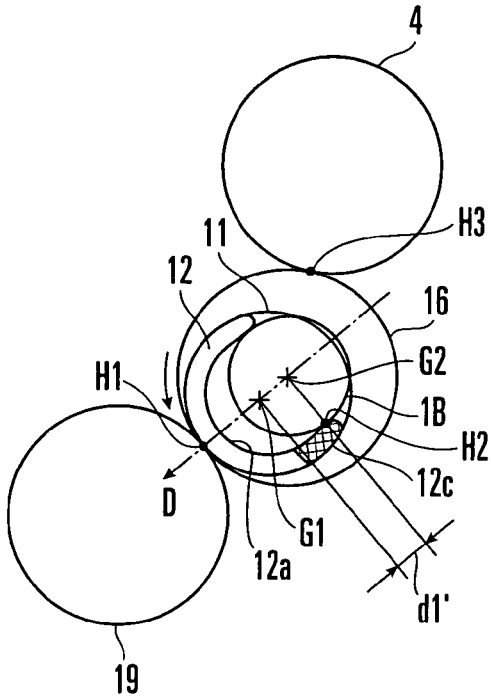

In this state, when the roller holder 11 is pivoted counterclockwise, as shown in FIG. 4B, a support (a cross-hatched portion) 12*c* as the lower-side one end portion of the bearing 12 of the roller holder 11 which supports the bearing 18 of the distribution roller 16 slightly moves the distribution roller 16 obliquely upward. At this time, the support 12*c* serves as a shaft support that supports the shaft of the distribution roller 16. Thus, the distribution roller 16, while being held in contact with the ink roller 19, comes into contact with the oscillating roller 4.

As shown in FIG. 2, one end of a lever 21 is axially mounted on the second small shaft 14 of the roller holder 11, and one end of a rod 23 is pivotally mounted on the other end of the lever 21 through a pin 22. Accordingly, when the rod 23 moves in the axial direction, the other end of the lever 21 also moves. As the lever 21 moves, the second small shaft 14 pivots, and the roller holder 11 also moves together with the second small shaft 14.

A screw hole 24*a* parallel to the inner frame 10 is formed by threading in the inner surface of a stud 24 perpendicularly projecting from the inner frame 10. A substantially cylindrical movable element 25 has a through hole 25*a* at its central portion, threaded portion 25*b* on its outer surface, and flange 25*c* at its one end. When the threaded portion 25*b* threadably engages with the screw hole 24*a*, the movable element 25 is supported by the stud 24 to be movable in the directions of arrows A-B. When the flange 25*c* engages with the stud 24, the movable element 25 is regulated from moving in the direction of the arrow B. The rod 23 is loosely inserted in the through hole 25*a* of the movable element 25 such that the distal end of the rod 23 projects from the flange 25*c*. An engaging ring 26 is fitted on the projecting end portion of the rod 23.

A locking ring 27 is fitted on end side of the rod 23, and a compression coil spring 28 as a biasing member is elastically mounted between the ring 27 and the end face of the movable element 25. A substantially bottomed cylindrical knob 30 is integrally placed on the flange 25*c* of the movable element 25 with a set screw 31. A space 32 is formed between the knob 30 and flange 25*c*, to accommodate the projecting end portion of the rod 23, projecting from the flange 25*c*, in a noncontact manner.

In this arrangement, when the knob 30 is pivoted to move the movable element 25 in the direction of the arrow B, the flange 25*c* abuts against the stud 24. At this time, the compression coil spring 28 elastically mounted between the ring 27 and movable element 25 is compressed, and the spring force of the compression coil spring 28 moves the rod 23 in the direction of the arrow B. As the rod 23 moves, the lever 21 pivots counterclockwise as shown in FIG. 3B about the second small shaft 14 of the roller holder 11 as the pivot center. When the lever 21 pivots, the second small shaft 14 also pivots counterclockwise, and the roller holder 11 also pivots counterclockwise.

Then, the distribution roller 16 comes in contact with the oscillating roller 4, as described above, such that their outer surfaces are in tight contact with each other (FIG. 4B). In this state, a gap t is formed, as shown in FIG. 2, between the ring 26 of the rod 23 and the flange 25*c* of the movable element 25. The nip pressure between the distribution roller 16 and oscillating roller 4 generated by the spring force of the compression coil spring 28 is set to a predetermined value by adjusting the gap t.

In this manner, to generate the predetermined nip pressure between the distribution roller 16 and oscillating roller 4 by the spring force of the compression coil spring 28, the spring force of the compression coil spring 28 is transmitted to the second small shaft 14 of the roller holder 11 through the lever 21. In addition, a length d2 (FIG. 3A) between the pin 22 of the lever 21 and the second small shaft 14 is set larger than the distance d1 (FIG. 4A) between the shaft center G1 of the bearing 12 of the roller holder 11 and the shaft center G2 of the distribution roller 16.

More specifically, the distance d2 between the center of the pin 22 serving as the power point where the spring force of the compression coil spring 28 acts on the lever 21 and the shaft center G1 of the first small shaft 13 serving as the pivot center of the roller holder 11 is set larger than the distance d1 between the shaft center G1 as the pivot center of the roller holder 11 and the shaft center G2 of the distribution roller 16. With this arrangement, the lever 21 exerts leverage, so that the predetermined nip pressure can be generated between the distribution roller 16 and oscillating roller 4 without increasing the spring force of the compression coil spring 28.

The operation of attaching and detaching the distribution roller 16 in the roller support apparatus having the above arrangement will be described.

First, the attaching operation of bringing the distribution roller 16 into contact with the oscillating roller 4 will be described. As shown in FIG. 3A, the opening 12*b* of the bearing 12 of the roller holder 11 is directed in the direction of the arrow A in advance. In this state, the bearing 18 of the distribution roller 16 is engaged into the bearing 12 of the roller holder 11 through the opening 12*b*, to bring the distribution roller 16 into contact with the ink roller 19. At this time, as described above, the shaft center G2 of the distribution roller 16 is located to deviate from the shaft center G1 of the roller holder 11 by the distance d1. Substantially, the knob 30 is pivoted to move the movable element 25 in the direction of the arrow B, so that the flange 25*c* abuts against the stud 24. Thus, the compression coil spring 28 is compressed, and the rod 23 is moved in the direction of the arrow B by the spring force of the compression coil spring 28.

At this time, since the movable element 25 is moved in the direction of the arrow B against the small spring force of the compression coil spring 28, the pivoting force of the knob 30 can be decreased, thus improving the operability. As the movable element 25 moves in the direction of the arrow B, the lever 21 pivots counterclockwise as shown in FIGS. 3B and 4B about the second small shaft 14 of the roller holder 11 as the pivot center. Accordingly, the second small shaft 14 also pivots counterclockwise, and the roller holder 11 also pivots counterclockwise. Therefore, as described above, the distribution roller 16 comes into contact with the oscillating roller 4, such that their outer surfaces are in tight contact with each other with the predetermined nip pressure.

At this time, the force that urges the oscillating roller 4 with pressure from the distribution roller 16 generates a counterforce to urge the distribution roller 16 downward in FIG. 4B. As described above, the gap 20 is formed between the bearing 18 of the distribution roller 16 and the bearing 12 of the roller holder 11 in the direction of the ink roller 19 (direction of an arrow D). Thus, the counterforce toward the distribution roller 16 is transmitted in the direction of the arrow D as a partial force.

Hence, the distribution roller 16 moves in the direction of the arrow D as the bearing 18 is guided by the support 12*c* of the bearing 12 of the roller holder 11, and the distance between the shaft center G1 of the roller holder 11 and the shaft center G2 of the distribution roller 16 changes from d1 to d1' (d1>d1'). In this manner, the distribution roller 16 is urged in the direction of the arrow D so that its outer surface comes into tight contact with the outer surface of the ink roller 19, and the distribution roller 16 is brought into contact with the ink roller 19 with the predetermined nip pressure.

At this time, as shown in FIG. 4B, the distribution roller 16 is supported at a contact point H1 with respect to the ink roller 19, contact point H2 between the bearing 18 and the support 12*c* of the bearing 12, and contact point H3 with respect to the oscillating roller 4. When the distribution roller 16 is brought into contact with the oscillating roller 4 with the predetermined nip pressure, as described above, the distribution roller 16 is also brought into contact with the ink roller 19 with the predetermined nip pressure. Thus, the nip pressure adjusting operation can be performed easily within a short period of time.

The detaching operation of separating the distribution roller 16 from the oscillating roller 4 and the operation of changing the distribution roller 16 will be described.

When the knob 30 is pivoted, the movable element 25 moves in the direction of the arrow A from the state shown in FIG. 2, and the compression coil spring 28 expands to decrease its spring force. Accordingly, the biasing force to bias the rod 23 in the direction of the arrow B decreases. Thus, the lever 21 can pivot clockwise in FIG. 3B about the second small shaft 14 as the pivot center. In this case, the stud 24, the movable element 25 supported by the stud 24 to be movable forward/backward, and the knob 30 which moves the movable element 25 form a bias canceling means 35 which cancels bias of the compression coil spring 28 to the lever 21.

When the knob 30 is pivoted sequentially, the end face of the flange 25*c* of the movable element 25 abuts against the ring 26 of the rod 23, to move the rod 23 in the direction of the arrow A. Therefore, as shown in FIG. 3A, the lever 21 pivots clockwise about the second small shaft 14 as the pivot center.

Along with this, the second small shaft 14 also pivots clockwise, and the roller holder 11 also pivots clockwise, as shown in FIG. 4A. Therefore, the distribution roller 16 moves slightly obliquely downward due its own weight, and separates from the oscillating roller 4 to disengage from it.

In this manner, when the distribution roller 16 is to be separated from the oscillating roller 4 to disengage from it, the movable element 25 is moved in the direction of the arrow A by utilizing the spring force of the compression coil spring 28. Thus, the pivoting force of the knob 30 can be decreased, thus improving the operability.

In this state, when replacing the distribution roller 16, as shown in FIG. 4A, the bearing 18 of the distribution roller 16 is removed through the opening 12*b* of the bearing 12 of the roller holder 11 which is directed in the direction of the arrow A. Hence, the old distribution roller 16 can be removed from the roller holder 11. At this time, as shown in FIG. 4A, the distribution roller 16 is removed or attached as it is supported at two points, i.e., a contact point I1 with respect to the ink roller 19 and a contact point I2 between the bearing 18 and the support 12*c* of the bearing 12.

Subsequently, a bearing 18 of a new distribution roller 16 is engaged into the bearing 12 through the opening 12*b*. The old distribution roller 16 is changed for the new distribution roller 16 by the attaching operation of the distribution roller 16 described above. In this manner, as the opening 12*b* is formed in the bearing 12 of the roller holder 11, when the distribution roller 16 is to be changed, not only no tools are needed, but also the operation time can be shortened.

The distribution roller 16 is disposed inside the inner frames 10 arranged inside the frames 2. The levers 21, rods 23, compression coil springs 28, knobs 30, and the like are disposed outside the inner frames 10 (between the frames 2 and inner frames 10), respectively. Thus, the ink scattering from the distribution roller 16 can be regulated from scattering outside the inner frames 10, and the ink can be prevented from attaching to the levers 21, rods 23, compression coil springs 28, knobs 30, and the like. As a result, operation errors of the levers 21, rods 23, compression coil springs 28, knobs 30, and the like can be prevented, and the attaching/detaching operation of the distribution roller 16 can be performed reliably.

Figure 5A:
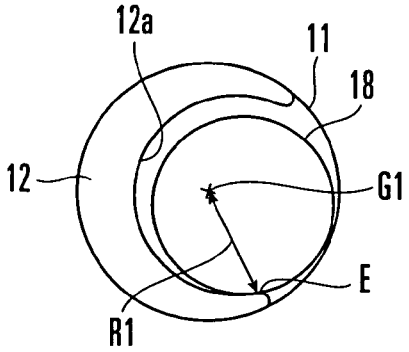
Figure 5B:
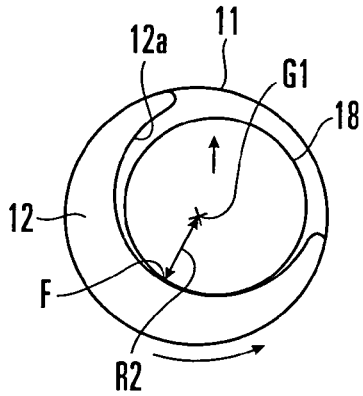

FIGS. 5A and 5B show the second embodiment of the present invention.

According to the characteristic feature of the second embodiment, a bearing portion 12*a* of a bearing 12 of a roller holder 11 is formed of a cam, so that the distance between the bearing portion 12*a* and a shaft center G1 of the roller holder 11 may gradually decrease from a lower-side one end (point E) toward a central side (point F). In other words, a distance R2 between G1 and the point F is set smaller than a distance R1 between G1 and the point E.

With this arrangement, when a bearing 18 of a distribution roller 16 is supported at the point E of the bearing portion 12*a*, as shown in FIG. 5A, the distribution roller 16 is separate from an oscillating roller 4. In this state, when the roller holder 11 is pivoted counterclockwise as shown in FIG. 5B, the bearing 18 is supported at the point F of the bearing portion 12*a*. As the distance R2 between G1 and the point F is set smaller than the distance R1 between G1 and the point E, the bearing 18 moves upward. Thus, the distribution roller 16 comes into contact with the oscillating roller 4.

In the respective embodiments described above, the bearing portion 12*a* of the bearing 12 of the roller holder 11 is formed to have a U-shape. Alternatively, only the support 12*c* which supports the bearing 18 of the distribution roller 16 may be formed. Although the above embodiments exemplify a case wherein the roller support apparatus is applied to a printing press, the roller support apparatus can also be applied to a coating device. Although the above embodiments exemplify a case wherein the roller support apparatus is applied to an inking device, the roller support apparatus can also be applied to a dampening unit.

The distribution roller 16 is brought into contact with the oscillating roller 4 by pivoting the roller holder 11 connected to the lever 21. Alternatively, one end of the lever 21 may be connected to a support member that supports the bearing 18 of the distribution roller 16. The distribution roller 16 may be brought into contact with the oscillating roller 4 by moving the support member.

As has been described above, according to the present invention, when the movable roller is to be brought into contact with or is to be separated from the stationary roller, the operability improves. When replacing the movable roller, not only no tools are needed, but also the operation time can be shortened. The operation of adjusting the nip pressure can be performed easily within a short period of time. As the ink can be prevented from scattering from the ink roller, the operation of attaching and detaching the movable roller can be performed reliably.

What is claimed is:

1. A roller support apparatus with which an outer surface of a first roller and an outer surface of a second roller come into contact with and separate from each other by radially moving said first roller, comprising:

a biasing member which biases said first roller in a direction to come close to said second roller;

a lever which transmits a biasing force of said biasing member to said first roller;

bias canceling means for canceling bias of said biasing member;

a roller holder which rotatably supports said first roller and pivots in accordance with movement of said lever;

an axial support which is provided to said roller holder and which engages with a shaft portion of said first roller, said axial support serving to bring the outer surface of said first roller into contact with the outer surface of said second roller in accordance with pivot motion of said roller holder; and an inner frame which is arranged inside a frame and supports said first roller, wherein said lever, biasing member, and bias canceling means are disposed between said frame and inner frame.

2. An apparatus according to claim 1, wherein a distance between a power point where the biasing force of said biasing member acts on said lever and a pivot center of said roller holder is set larger than a distance between the pivot center of said roller holder and a shaft center of said first roller.

3. An apparatus according to claim 1, wherein said axial support has a shaft center that deviates from a shaft center of said first roller when said first roller comes into contact with a third roller.

4. An apparatus according to claim 3, wherein when said first roller is in contact with said second roller, said first roller is guided by said axial support to be able to move in a direction to come into contact with said third roller.

5. An apparatus according to claim 1, further comprising a bearing portion which rotatably supports a shaft of said first roller and has said axial support on one end thereof, wherein said bearing portion includes a cam.

6. An apparatus according to claim 1, further comprising a bearing portion which rotatably supports a shaft of said first roller and has said axial support on one end thereof, wherein said bearing portion has an opening for attaching and removing a shaft portion of said first roller therethrough.

7. An apparatus according to claim 6, wherein said bearing portion is formed to have a substantial U-shape.

8. An apparatus according to claim 1, wherein said biasing member includes a compression coil spring fitted on a rod connected to a free end of said lever, and said bias canceling means includes a stud supported by a frame, a cylindrical movable element having a through hole through which said rod extends and supported by said stud to be able to move forward/backward, and an operation knob which is attached to an operation end of said movable element and to be pivoted.

9. An apparatus according to claim 8, wherein an outer surface of said movable element threadably engages with an inner surface of said stud.

10. An apparatus according to claim 8, further comprising a ring formed on an end of said rod projecting from said movable element toward said operation end, wherein said operation knob is pivoted to move said movable element, while being guided by said rod, in a direction to cancel the biasing force of said biasing member, and thereafter said operation knob is further pivoted to move said rod while an end face of said movable element abuts against said ring, to pivot said lever to separate said first roller from said second roller.

11. An apparatus according to claim 1, wherein said first and second rollers are a distribution roller and oscillating roller, respectively, that make up an inking device for a printing press.

12. An apparatus according to claim 1, further comprising:

a bearing portion which rotatably supports a shaft of said first roller and has said axial support on one end thereof, wherein said bearing portion has an opening for attaching and removing a shaft portion of said first roller therethrough, wherein when said first roller is to be replaced, said first roller is supported at a contact point with respect to a third roller arranged close to said first roller, and a contact point between a shaft portion of said first roller and said axial support, such that said first roller can be attached/removed.

13. An apparatus according to claim 1, further comprising:

a bearing portion which rotatably supports a shaft of said first roller and has said axial support on one end thereof, wherein said bearing portion has an opening for attaching and removing a shaft portion of said first roller therethrough, wherein when said first and second rollers are in contact with each other, said first roller is supported at a contact point with respect to a third roller arranged close to said first roller, a contact point between a shaft portion of said first roller and said axial support, and a contact point with respect to said second roller, and wherein said first roller is supported at three contact points with said opening being maintained at a predetermined open length.

14. An apparatus according to claim 13, wherein said opening has an open length slightly larger than the diameter of the shaft portion of said first roller.

15. An apparatus according to claim 1, further comprising a means for adjusting the biasing force of said biasing member to set the pressure between the first roller and the second roller at a predetermined nip pressure.

16. An apparatus according to claim 1, wherein said biasing member comprises a spring.

17. An apparatus according to claim 16, wherein said spring is a compression coil spring fitted on a rod which is pivotally mounted on said lever.

18. An apparatus according to claim 17, wherein said bias canceling means cancels the bias of said biasing means by relieving said compression coil spring of the compression exerted thereon.

* * * * *